United States Patent [19]

Meywald et al.

[11] 4,343,602

[45] Aug. 10, 1982

[54] GEAR WHEEL PUMP WITH REDUCED POWER REQUIREMENT

[75] Inventors: Volker Meywald, Arolsen-Mengeringhausen; Karl Ostertag; Klaus Schneider, both of Erlenbach, all of Fed. Rep. of Germany

[73] Assignee: Akzo, N.V., Arnhem, Netherlands

[21] Appl. No.: 39,968

[22] Filed: May 17, 1979

Related U.S. Application Data

[63] Continuation of Ser. No. 815,436, Jul. 13, 1977, abandoned.

[30] Foreign Application Priority Data

Jul. 13, 1976 [DE] Fed. Rep. of Germany ..... 2631341
Oct. 22, 1976 [DE] Fed. Rep. of Germany ..... 2647765

[51] Int. Cl.[3] ..... F04C 2/18; F04C 13/00; F04C 15/00

[52] U.S. Cl. ..... 418/77; 418/78; 418/81; 418/206

[58] Field of Search ..... 418/75, 77, 78, 81, 418/126, 131, 132, 205, 206

[56] References Cited

U.S. PATENT DOCUMENTS

| | | | |
|---|---|---|---|
| 1,706,829 | 3/1929 | Thomson | 418/77 |
| 1,913,633 | 6/1933 | Heil et al. | 418/206 |
| 2,639,694 | 5/1953 | Johnson | 418/206 |
| 2,996,999 | 8/1961 | Trautman | 418/132 |
| 3,135,217 | 6/1964 | Abel | 418/132 |
| 3,309,997 | 3/1967 | Kita | 418/206 |
| 3,472,170 | 10/1969 | Eckerle | 418/206 |
| 3,833,317 | 9/1974 | Rumsey | 418/77 |
| 4,032,391 | 6/1977 | Moked et al. | 418/206 |

*Primary Examiner*—John J. Vrablik
*Attorney, Agent, or Firm*—John H. Shurtleff

[57] ABSTRACT

A gear pump with reduced power requirement for conveying viscous liquids, especially thermoplastic fiber-forming polymer melts or a viscose spinning liquid, with intermeshed gear wheels rotatably mounted on parallel shafts while encased or circumscribed in a pump housing, i.e. enclosed on either side of the gear wheels and around the periphery thereof with an inlet opening for liquid feed means leading into the meshed point or area where the gear wheels disengage or become unmeshed and with an outlet opening for liquid discharge means leading away from the meshing point or area where the gear wheels engage or become meshed, the liquid thus being conveyed by the gear teeth from the inlet opening on one side of the meshing point around the outer portion of each gear to the outlet opening on the other side of the meshing point. A normal pressure-sealing or backflow-inhibiting radial gap is provided over at least a portion of each gear wheel periphery, i.e. between the top land or crown of the gear teeth and the opposing inner walls of the gear housing, preferably over a distance from the outlet opening of at least about three gear teeth or more. The remaining normally liquid-sealing gap spaces between the gears and the housing are enlarged according to the invention by means of axial recesses in the side faces of the gears and/or in the adjacent internal faces of the gear housing which extend in a plane perpendicular to the gear axes, and/or by means of radial recesses along the inner circular surfaces of the gear housing which extend around a major portion of each gear periphery, each of said recesses being formed circularly or as a sector of a circle, i.e. an arc-shaped recess defined herein as a segmental annulus which in the axial enlargement has the form of a flat annular sector of a circle or which in the radial enlargement has the form of an annular ring segment, and each of said recesses being arranged concentrically to the axis of its associated gear wheel. A gear pump of the invention is especially preferred which has only axial recesses or which has a combination of axial and radial recesses.

17 Claims, 5 Drawing Figures

GEAR WHEEL PUMP WITH REDUCED POWER REQUIREMENT

This is a continuation of application Ser. No. 815,436, filed July 13, 1977, now abandoned.

The invention concerns a gear pump with reduced power requirement for the conveyance of viscous liquids.

In general, so-called positive displacement pumps and particularly rotary piston pumps are used for the conveyance of viscous liquids. A special form of these rotary piston pumps are gear pumps in which generally two equally sized intermeshed gears constitute the rotary pistons. Since these pumps often must convey a viscous liquid against high differential pressures or against differential pressures which are variable with time, and since in most cases it is required that the conveyed stream be practically insensitive to differential pressure, it was previously common practice in these pumps to make the gap which is necessarily formed between the rotating gears and the wall of the pump housing, namely on the end surfaces as well as on the side surfaces of the gears, as pressure tight as technically possible in order to seal the pressure (feed) chamber off from the suction (discharge) chamber and thereby to avoid a reverse leakage flow or backflow of the conveyed liquid from the pressure (intake) side to the suction (outlet) side; to avoid undesired wear hereby, actual contact between the housing and the rotating gears had to be avoided. As a rule there was thereby no possibility for the material in the axial gap to flow, which especially in the case of synthetic thermoplastic polymer melts could lead to thermal damage of the polymer and thereby to flaws in the product being manufactured.

The axes or shafts for the gears are fitted into the pump housing with very minimal tolerances also, a feature which is very important for avoiding leakage flows.

Through the use of more than two gears, multiple pumps can be produced, e.g. with an installation of three gears on parallel axes, such pumps can be made with two intakes and two outlets.

In the conveyance of viscous liquids with this type of gear pump, previously only a small portion of the power required by the pumps actually serves to convey the liquid medium, i.e. to transport a flow volume from the pressure level on the pressure or intake side to the pressure level on the suction or outlet side. The other portion of the operating energy, which is often quite significant, is needed to overcome the shear stresses which arise in the extremely narrow gaps. This energy portion, which sometimes amounts to 80% of the total power required by the pump, is transformed in the pump into a heat loss, especially through inner friction in the conveyed liquid medium, and is therefore no longer available for the actual liquid conveyance; the efficiency of the gear pump is thereby significantly reduced. Furthermore, the heat loss produced in the conveyed medium necessarily leads to an often significant, undesirable increase in the temperature of said liquid medium. However, even such a heating of the conveyed medium, which is generally measurable as only a moderate temperature increase, amounts to only a few degrees, one cannot exclude the possibility that local overheating and a resulting thermal damage will arise in said medium.

From the Dutch Pat. No. 6,502,896 a viscose gear pump is known in which the driven gear is smaller than the drive gear whereby the axial gap between the pump housing and the driven gear is greater than that between the housing and drive gear. Through this measure, the power which is to be transferred from the drive gear to that which is to be driven is reduced. Because of the leakage losses or backflow which necessarily occur between pressure side and suction side, and which are higher and severely dependent on differential pressure, this pump is not suitable for use as, for example, a spinning pump in the manufacture of synthetic threads. The variations in pressure differential between the suction side and the pressure side of this pump which unavoidably appear in such spinning processes and which can rise, for example, to 300 bar in the course of one nozzle cycle, cause denier variations or insufficient deniers in the spun threads. To this extent, this known gear pump confirmed the previous view of the industry that the radial and axial gaps of such pumps should be dimensioned as narrowly as technically possible, to maintain an even delivery flow, which is not sensitive to differential pressure; for this reason, e.g. conventional spinning pumps exhibit equally narrow gaps of 5 to 30 μm over their entire circumference.

The object of the present invention is, therefore, to create a gear pump with a reduced power requirement for conveying viscous liquids, while maintaining normal, pressure-insensitive conveying characteristics.

This object is fulfilled by means of a gear pump, in which, according to the invention, the radial gap between the meshing gears and the pump housing is enlarged by means of recesses on the inside and surfaces of the pump housing, and/or the axial gap between the meshing gear; and the pump housing is enlarged by means of recesses on the inside surfaces of the pump housing and/or by means of recesses on the side surfaces of the meshing gears, whereby the recesses are constructed in circular or arc shapes and arranged concentrically to the axes of the intermeshed gears.

The circular or arc-shaped recesses can thereby have a depth which remains equal in radial direction, but also have a depth which increases or decreases, either steadily or in leaps, i.e. stepwise. In the same way, they can have a cylindrical or conical form. Advantageously, the depth of the recesses lies in the range of 40 to 60 μm measured radially in the case of radial gaps and axially in the case of the axial gaps, and the gap width in the enlarged region of the axial gap amounts up to 15 times the gap width in the non-enlarged region of the axial gap, whereby a preferred range for the gap width in the enlarged region of the axial gap is 2 to 12 times the gap width in the non-enlarged region of the axial gap. It can also be advantageous if the gap width in the enlarged region of the axial gap is larger by 5 to 70 μm than that in the non-enlarged region of the axial gap.

In a further development of the invention, the radius of the axial recesses is smaller by at least one-half gear module than the radius of the root circle of the intermeshed gears or, in the case of the recesses arranged on the inside surfaces of the pump housing, the radius of the axial recesses is equal to one-half of the pitch diameter of the meshing gears.

In order to prevent possible leakage via the drive shafts, it is advantageous to extend the axial recess only so far in the direction of the axle or shaft in the housing that a collar remains, whereby in this collar area the originally narrow tolerances are retained, and to enlarge the radial gap to its total width.

In one preferred embodiment, the recesses for enlarging the radial gap are extended in the direction of conveyance starting from the intake opening of the conveyed liquid, but not however up to the outlet opening of the conveyed liquid. Good results are thereby achieved with a gear pump which has these recesses extend along an arc length in the range of 180°–210°, starting at the intake or inlet opening, in such a way that they terminate in front of the outlet opening at an interval which corresponds approximately to twice to three times the circular pitch of the intermeshed gears. The circular pitch is equal to the circumference of the pitch circle divided by the number of teeth, as given by the equation:

$$p=(\pi D/N)$$

Where p is the circular pitch, D is the pitch diameter and N is the number of teeth.

A special form of the gear pump according to the invention provides for an arrangement of additional recesses in the form of annular ring segments on the inside surfaces of the pump housing, which have an inner radius equal to the radius of the circular or arc-shaped recesses and which extend only along a partial circumference in such a way that they begin and end respectively, at a distance from the suction (inlet) opening and pressure (outlet) opening which corresponds to an angle of at least 10°. With especially critical liquids, high pressure differentials or severe variations in differential pressure, it is especially advantageous to terminate these additional recesses in each case with the ends at a distance corresponding to an angle of 20°, and in extreme cases an angle of 30°, for a sufficient sealing of the pressure chamber of the pump from its suction side.

In the present invention, the radius or inner radius of the recesses is to be understood as the radius measured in each case in the planes defining the axial gap. The root circle of the intermeshed gears is here the outer boundary line given by the gears if their teeth are completely removed. The radius of the root circle is derived from the radius of the crown line or top circle, that is the outer boundary line of a gear with the teeth thought of as being filled in, reduced by the heighth of the particular teeth measured in radial direction (compare also DIN 868 and "Betriebshütte", Vol. I, 1964 Edition, pp. 770 and 771). The gear module in the sense of this invention is the quotient which is also known as in its reciprocal form as the diametral pitch, derived from the pitch diameter and the number of teeth or the circular pitch and $\pi$ (compare also DIN 780 and DIN 868; "Meyers Lexikon der Technik und der Naturwissenschaften", Vol. III, 1970 Edition, pp. 2778 and 2779, as well as "Betriebshüttle", Vol. I, 1964 Edition, pp. 770 and 771). The value which designates the "depth" of the recesses is that by which the particular region of the axial gap is enlarged by the recesses.

The enlargement of the radial gap has a power-reducing effect along a circumferential section which is of no consequence for the pressure build-up. This is even more true as the viscosity of the medium to be conveyed rises. A length of approximately three teeth is considered sufficient for the circumferential section which is needed for the pressure build-up and which has a radial gap kept as narrow as technically possible so that the increased liquid pressure in the outlet does not cause a leakage flow opposite to the direction of conveyance. The enlargement of the axial gap has the effect of skirting the side surfaces of the gears along a defined surface to just such an extent that no shorting between pressure side and suction side is possible.

The dimensioning of the recesses is not restricted, of course, to the range designated above as advantageous, but other values can also prove to be suitable, according to conditions.

Recesses can be made by means of grinding or cutting or other metal removing processes. Since this can be carried out on conventional types of lathes, however, it is possible to make larger numbers of gear pumps with circular recesses in a narrow tolerance range, e.g. in the use of such pumps as spinning pumps for assuring evenness of denier. Besides, the gear pump according to the invention achieves a conveying characteristic of being insensitive to differential pressure changes, even with high differential pressures, as was known previously only to be true of gear pumps without enlarged gaps. Thus, for example, when pumps according to the invention are used as spinning pumps, the possibility of maintaining a narrow tolerance range results in the desired uniformity of denier from spinning point to spinning point, and the pressure-insensitive conveyance results in denier uniformity at each individual spinning point throughout a nozzle cycle or running time. All structural materials commonly used for such pumps are suitable for the gear pump according to the invention, since the circular or arc-shaped recesses do not place any additional demands on the pump according to the invention. On the contrary, the reduced heating of the conveyed medium while it is transported through the pump, as can be achieved by the new gear pump described herein, leads in many cases to a significant reduction or even elimination of thermal damage to the conveyed medium, something which occurs frequently in known pumps, and also leads to a correspondingly marked reduction in the thermal stress on the pump material. To this extent the pump according to the invention is thus subject to no restrictions beyond those common to already known gear pumps of the same type.

Since the power loss needed to overcome the shearing stresses which occur in the even and extremely narrow gaps of conventional pumps increases as the viscosity of the conveyed medium increases, the gear pump according to the invention is especially suitable for conveying and dosing thermoplastic synthetic polymers in a molten state, such as polyethylene terephthalate, polyhexamethylene adipamide, polycaprolactam, etc. and viscose, as well as other highly viscous substances and their solutions and suspensions, emulsions and the like.

The gear pump according to the invention is thus also particularly suitable as a spinning pump for spinning thermoplastic synthetic filaments or viscose threads in which a high degree of denier uniformity is important.

In general, it is unimportant for the amount of reduction in the power requirement of the gear pump whether the recesses are located in the side surfaces of the intermeshing gears or along the inside surfaces of the pump housing. However, from the point of view of production technology, it is generally most practical to place circular recesses of a cylindrical or slightly conical form of uniform depth in the axial dimension only on the side surfaces of the intermeshing gears, since this can be done easily on conventional turning machines with the necessary precision and can therefore be allowed for already in the production and processing of the semi-finished gears on such machines. However, the effect is not diminished if circular and/or arc-shaped recesses are provided on the inner surfaces of the pump housing. In this case it is generally practical to make these recesses before the final processing of the pump housing surface in question, since in this way the size of the inner pump housing surfaces generally subject to microfinishing is reduced.

If, for example, a slight warming of the conveyed medium while it is being transported through the pump is desired, it is also possible to locate circular recesses only on one of the two side surfaces of only one of the intermeshed gears or on only one side surface of each of the two intermeshed gears. The same applies analogously to the location of the circular and/or arc-shaped recesses on the inner surfaces of the pump housing. Thus any desired warming or mixing of the conveyed medium in the pump can be affected within limits in this way—i.e. by the number of recesses and their location.

If several circular and/or arc-shaped recesses are provided on the inner surfaces of the pump housing and/or several circular recesses on the side surfaces of the gears, these can have the same or differing radii. It must be noted in each case, however, that the radius of each of these recesses must be at least enough smaller than the root circle radius of the meshing gears that a sufficient sealing of the pressure side of the pump from the suction side is ensured with certainty. Preferably, one should first experiment with a known pump, i.e. a gear pump without recesses, to determine the conveying performance of this pump and then gradually enlarge the radius of the circular or arc-shaped recesses starting from the radius of the drive shaft of the driving gear or the axle of the driven gear or from the bores in the pump housing provided for bearing same, as long as the conveying performance of this pump is definitely not impaired by the maximum differential pressures and/or fluctuations in differential pressure which occur under operating conditions. In many cases, the radius which is smaller than the radius of the root circle of the meshing gears by at least half a gear module has proven advantageous. With especially critical liquids, high differential pressures or sharp differential pressure fluctuations, a radius for the circular or arc-shaped recesses which is smaller by one gear module and in extreme cases one which is smaller by two gear modules than the radius of the root circle of the gears has proven suitable for a reliable sealing of the pressure chamber of the pump from its suction side.

In gears having a gear module of below 2 mm, the radius of the circular or arc-shaped recesses is preferably at first experimentally measured to be at least 1 mm smaller than the radius of the root circle of the meshed gears. However, if it is then proven that a further increase of the radius of these recesses above this value causes no impairment of the operational behavior of the pump, then under these circumstances, the recesses can be enlarged further in the radial direction.

Particularly in the use of spinning pumps according to the invention—also called metering pumps—special attention should be paid to a uniform, constant conveyance practically unaffected by the differential pressure in order to ensure that the threads or filaments spun with gear pumps according to the invention also meet the strict requirements for denier evenness which is determined for example on conventional Uster evenness testers.

It is also most expedient to determine the optimum depth of the circular or arc-shaped recesses which will satisfy all requirements for the behavior of the pump in its respective application by doing an experiment in which one starts again with a pump without recesses and then gradually increases the depth of the recesses. In this way one pump generally suffices in the experiment to determine the optimum depth of the recesses for each individual case. If circular recesses are located on the side surfaces of the gears, one must make an additional experiment to ensure that this does not cause any weakening of the gear ring which would lead to breakage when the pump is stressed under operating conditions. If several circular and/or arc-shaped recesses are provided on the inner surfaces of the pump housing and/or several circular recesses on the side surfaces of the gears, they may have the same or differing depths. A determining factor for the reduction of the power requirement of the pump, in addition to the radius of the recesses, is in general the ratio of the gap width in the enlarged area to that in the non-enlarged area. A gap width which in the enlarged area is up to 15 times that in the non-enlarged area has proven expedient and sufficient for a frequently substantial reduction of the power requirement of the pump.

Depending on the viscosity of the liquid to be conveyed and its rheological behavior, even a gap width which in the enlarged area of the gap is twice that in the non-enlarged area can effect a substantial reduction in the power required by the pump.

It is also possible, depending on the qualities of the conveyed medium and/or the operating conditions where the pump is used, that a widening of the gap in one area to 12 times the gap width in the non-enlarged area is most expedient, and going beyond this does not provide any further advantage.

In gear pumps with axial gap widths of up to 5 μm, e.g. in the non-enlarged area, depending on the conveyed medium, even a gap width which is 5 μm larger in the enlarged area can result in a substantial reduction of the power requirement of this pump. It is also possible in such pumps that even a gap width which is 70 μm larger in the enlarged area than in the non-enlarged area effects such a reduction in the power requirement that a further enlargement of the axial gap in this area does not provide any greater advantage.

An additional reduction of the power requirement of gear pumps with circular and/or arc-shaped recesses is achieved by means of additional annular recesses shaped as ring-segments on the inner surfaces of the pump housing, which extend only on a partial circumference and begin or end most preferably at a distance of at least 10° from the suction port and the pressure port, respectively. Where there are especially critical operating conditions, it is safer to have this distance be 20° in each instance and in extreme cases preferably 30°. In these additional recesses, the inner radius of the annular ring segment is equal the radius of the circular or arc-shaped recesses, while the outer radius of these additional annular ring segments can be equal to or even larger than the root circle radius of the intermeshed gears.

The optimum dimensions of these additional recesses for the respective application of the pump area are also determined expediently in an experiment with only one pump by gradually enlarging the outer radius, the depth or the length of the partial circumference of these recesses. The depth of the additional annular ring segments can be equal to that of the circular or arc-shaped recesses or also larger or smaller.

If arc-shaped recesses and additional recesses in the shape of annular ring segments are both called for, they can also have partial circumferences of different sizes. In general, circular and/or arc-shaped recesses and the additional ring-segment recesses can be made in the same pump housing surface in one operation.

In general, every enlargement of the radii and the depths of the recesses within the given limits—in some cases even beyond these limits—produces a reduction in the power requirement of the gear pump according to the invention.

The invention will now be explained in greater detail with the aid of the accompanying drawings. These show the following:

Figure 1:
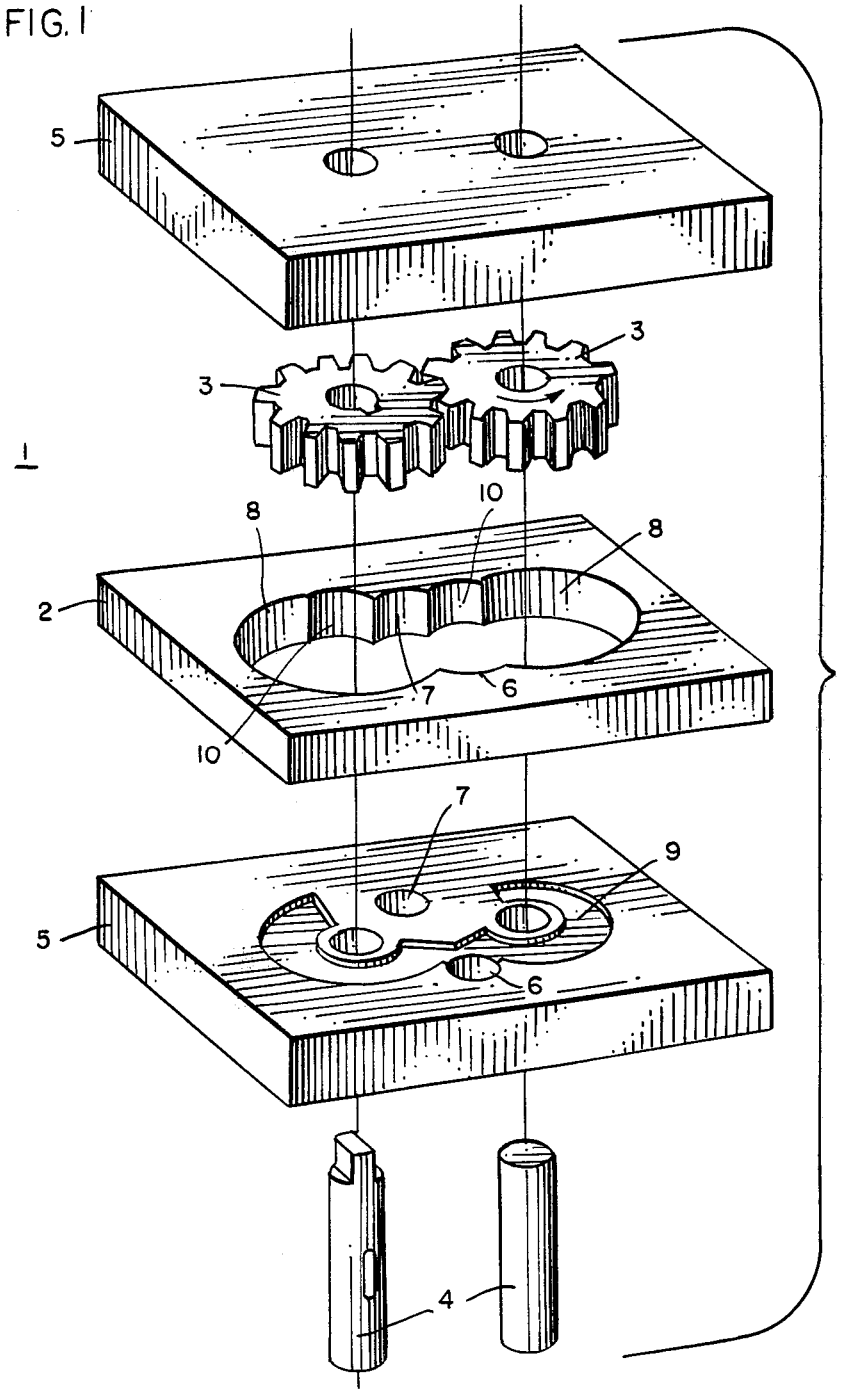
FIG. 1 is the perspective illustration of the essential parts of one embodiment of the pump according to the invention in an exploded view with enlarged radial and axial gaps.
Figure 2:
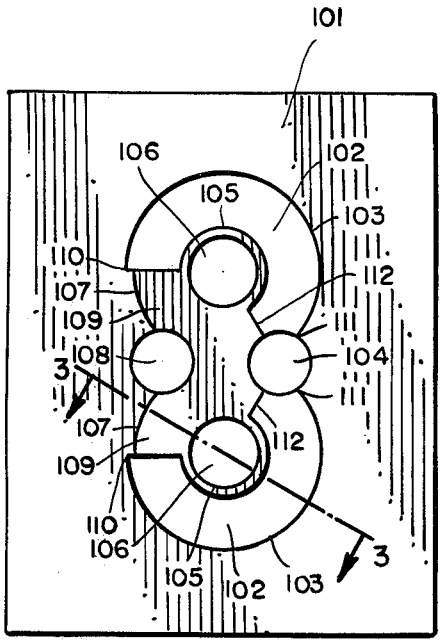
FIG. 2 illustrates the inner surface of the pump housing of a pump according to the invention with enlarged radial and axial gaps.
Figure 3:
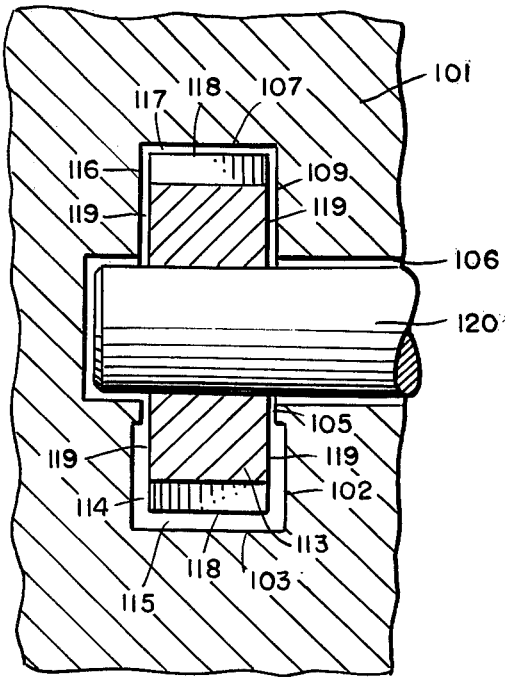
FIG. 3 illustrates a cut-away of a pump according to the invention along line 3—3 of FIG. 2 with the gear pertaining thereto.

The gear pump 1 shown in FIG. 1 consists of center plate 2, gears 3, axes 4 and side plates 5. Located on the center plate 2 are inlet 6 and outlet 7 for the conveyed medium, and further the two recesses 8 for the radial gap enlargement over the gears. In each of the side plates 5 are two recesses shaped as ring segments 9 for the axial gap enlargements which border on gears 3 in center plate 2.

The intermeshing gears 113 rotate in the space formed by the housing inner end faces 103;107 and the housing inner side surfaces 102; 109, with their shafts or axles 120 supported in bushings 106. The medium to be conveyed enters the pump through inlet port 104 and is conveyed into the spaces between the teeth of gears 113 along end faces 103;107 to the pressure side of the pump and leaves the pump through the discharge port 108. The radial gaps 115 between the end surface 118 of the gears 113 and the pump housing inner end faces 103 extend in their entire width along an arc which goes from the point 110 near the pressure side of the pump to point 111 on the suction side of the pump, further than in the remaining short, non-enlarged region 107 which goes from point 110 near the pressure side of the pump to discharge port 108. This means that the enlarged inner end faces of the housing 103 of pump housing 101 form a circular arc which has a larger radius relative to the mid-point of bushings 106 than the non-enlarged housing inner end faces 107 of pump housing 101. Thus an indentation or step in the form of an edge can be seen clearly at point 110 near the pressure side of the pump.

The axial gaps 114 formed between side surfaces 119 of the gears 113 and the inner side surfaces 102 of pump housing 101 are along an arc length which stretches from point 110 near the pressure side to point 112 near the suction side, wider than in the remaining short, non-enlarged region 109 of pump housing 101, and the enlarged axial gap 114 extends out radially toward bushings 106 only so far as to form a collar 105 in each case which is on the same plane as the non-enlarged housing inner side surfaces 109.

At points 110 and 112, which bound the arc length of the enlarged housing inner side surface 102, one can also clearly recognize steps in the form of edges.

Figure 4:
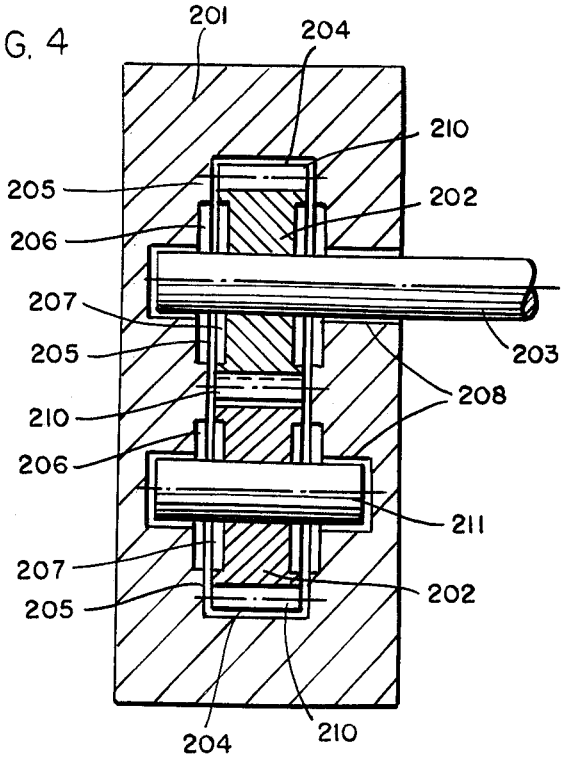
FIG. 4 illustrates the inner surface of the pump housing of a pump according to the invention with enlarged axial gaps.

The two intermeshed gears 202 in FIG. 4 are rotatably supported with their drive shaft 203 and axle 211 respectively in in the bores 208 of housing 201 provided for this purpose. Radial gap 204 and portion 205 of the axial gap, which is opposite the side surfaces of teeth 210 on both sides, are of the usual narrow gap width. The remaining portion of the axial gap is enlarged by circular recesses 206 in housing 201 and by circular recesses 207 in gears 202.

Figure 5:
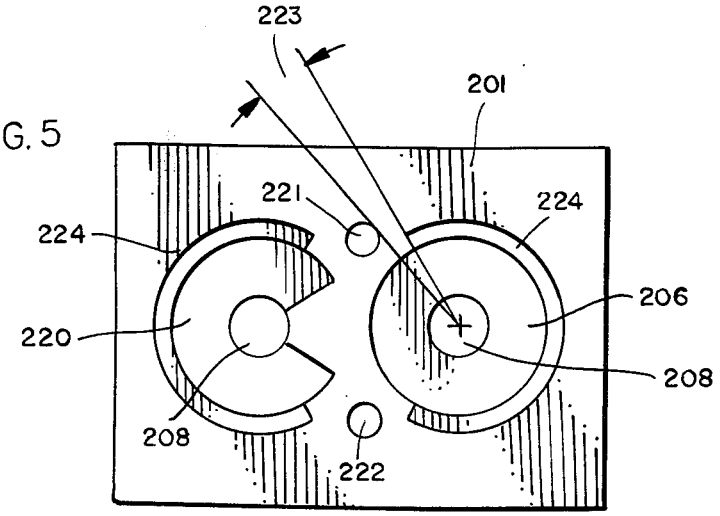
FIG. 5 illustrates the inner surface of the pump housing of a pump according to the invention with enlarged axial gaps.

The inner surface of gear pump housing 201, as shown in FIG. 5 with suction port 221 and pressure port 222 and the bores 208 provided for drive shaft 203 and axis 211 respectively of the gears 202, has an arc-shaped recess 220 and an additional annular ring-segment recess 224 on the left side of the housing inner surface. These recesses 220 and 224 extend over arcs of differing lengths and have differing depths. A circular recess 206 and an additional annular ring-segment recess 224 are shown on the right side of the housing inner surface. Each has a different depth. The additional annular ring-segment recesses 224 extend around a partial circumference only so far that they begin or end at a distance from the suction port 221 and the pressure port 222 which corresponds to angle 223.

EXAMPLE 1

A gear pump according to the invention with enlarged radial and axial gaps was used to spin a polyethylene terephthalate melt with a solution viscosity of 1.62. This was a so-called double spinning pump. The output of the pump was $2\times2.4$ cm$^3$/rev.; each of the intermeshed gears had 24 teeth. The melt had a normal temperature of approximately 285° C., and the differential pressure was approximately 30 to 43 bar. The axial and radial gaps in this pump were enlarged over an arc length of approximately 200° by grinding out 50 μm on each side, with the radial gap being enlarged along its entire width, while in the axial gaps towards the shaft a 1 mm wide collar was left in the original state to avoid increasing sluggishness toward the drive shaft and outside. The power requirement of this pump was only approximately 67% of what is normal for comparable pumps.

EXAMPLE 2

In an experiment, a gear pump with enlarged axial gaps was compared with one without enlarged axial gaps. The conveyed medium in this case was polyisobutylene with a viscosity of 80 pa's at 25° C. Both pumps had an output of $2\times1.2$ cm$^3$/rev. In the pump according to the invention, the axial gaps were enlarged from 5 μm to 61 μm by circular recesses which were concentric with the axes of the intermeshed gears on both side surfaces of the two gears. The radius of each circular recess was 10 mm and was thus smaller by one gear modulus ($m=1$ mm) than the radius of the root circle of the gears. The remaining dimensions of the two intermeshed gears were as follows: Number of teeth 24, top (addendum) circle diameter 25.7 mm, and width 8.89 mm. The expertiment was made at differential pressures between 40 and 180 bar and speeds between 15 and 40 rpm. Both pumps were driven by a common shaft. The pump according to the invention had a power requirement up to 16% lower than that of the comparison pump, corresponding to an approximately 28.5% reduction in the total power loss caused by shearing stresses in the pump, while neither the output nor the conveyance behavior of the two pumps differed from each other.

EXAMPLE 3

In a second experiment, a gear pump with the same dimensions as in Example 2, except that the circular recesses with the same dimensions as in Example 2 were located on the inner surfaces of the pump housing, was compared with the pump without recesses. With this pump, too, the same good results were achieved as described in Example 2.

EXAMPLE 4

For another comparative experiment, in a gear pump with otherwise the same dimensions as in Example 2, the axial gap was enlarged from 5 μm to 40 μm by means of arc-shaped recesses and annular ring-segment recesses on the inner surfaces of the pump housing which extended only over a circular arc of 225°; the recesses in each case ended at a distance from the suction port and pressure port corresponding to an angle of about 12°. The outer radius of the annular ring-segment recesses was 13 mm. The reduction in the power requirement of this gear pump with no change in conveyance behavior under the experimental conditions described in Example 2 was approximately 20%.

The invention is hereby claimed as follows:

1. A gear pump with reduced power requirement for the conveyance of viscous liquids, especially thermoplastic fiber-forming polymers or a viscose spinning liquid, said pump comprising meshed gear wheels mounted rotatably on parallel shafts in a pump housing circumscribing the gear wheels with liquid inlet means leading into the meshing point where the gear wheels disengage and liquid outlet means leading away from the meshing point where the gear wheels engage, a normal pressure-sealing gap space between the gears and the housing being enlarged by means of axial recesses in the side faces of the gears or in the adjacent internal facing surfaces of the gear housing which extend perpendicular to the gear axes, each of said enlarged axial recesses being formed only circularly or as a circular segment with each such circular recess being arranged concentrically to the axis of its gear wheel and extending radially inwardly up to a collar around the shaft of its gear wheel.

2. A gear pump as claimed in claim 1 wherein the circular axial recess extends from a collar directly adjacent the gear shaft up to a radius which is smaller than the root circle radius of the gear wheel.

3. A gear pump as claimed in claim 1 in which the depth of the recesses, measured axially in the axial gap spaces, lies in a range of about 40 to 60 μm.

4. A gear pump as claimed in claim 1 having axial recesses wherein the gap width in the enlarged zone of the axial gap space amounts to up to 15 times the gap width in the non-enlarged zone of the axial gap space.

5. A gear pump as claimed in claim 1 having axial recesses wherein the gap width in the enlarged zone of the axial gap space is about 5 to 70 μm larger than in the non-enlarged zone of said axial gap space.

6. A gear pump as claimed in claim 1 having axial recesses wherein the radius of the axial recesses is approximately at least one-half gear module smaller than the radius of the root circle of the gear wheels.

7. A gear pump as claimed in claim 1 having axial recesses wherein the radius of the axial recesses located along the internal facing surfaces of the housing is equal to about half the pitch diameter of the gear wheels.

8. A gear pump as claimed in claim 1 wherein the collar is approximately 1 mm wide.

9. A gear pump as claimed in claim 1 having axial recesses wherein the recesses forming the axial gap enlargement along the internal surfaces of the gear housing facing the sides of the gears extend from the opening of the liquid inlet means around each gear wheel in the direction of the conveyed liquid but terminate short of the opening of the liquid outlet means.

10. A gear pump as claimed in claim 9 wherein the axial recesses forming the axial gap enlargement extend along an arc length in the range of about 180° up to about 210° proceeding outwardly from the inlet opening in such a manner as to terminate at a distance before the outlet opening which corresponds to about twice to three times the circular pitch of the intermeshed gears.

11. A gear pump as claimed in claim 1 wherein the normal pressure-sealing gap space between the gears and the housing are further enlarged by means of radial recesses along the inner circular surfaces of the gear housing around each gear periphery.

12. A gear pump as claimed in claim 11 having radial recesses wherein the recesses forming the radial gap enlargement extend from the opening of the liquid inlet means around the circumference of each gear wheel but terminate at least about three teeth short of the opening of the liquid outlet means.

13. A gear pump as claimed in claim 12 wherein the radial recesses forming the radial gap enlargement extend along an arc length in the range of about 180° up to about 210° proceeding from the inlet opening in such a manner as to terminate at an interval before the outlet opening which corresponds to about twice to three times the circular pitch of the intermeshed gears.

14. A gear pump as claimed in claim 1 wherein only the axial gaps are enlarged.

15. A gear pump according to claim 14 wherein the enlarged axial gaps are formed by circular recesses arranged only in the side faces of the intermeshed gear wheels.

16. A gear pump as claimed in claim 14 wherein the enlarged axial gaps are formed by at least one circular recess arranged in the side faces of the gear wheels or are formed by at least one circular recess or an annular sector of a circle arranged along the internal facing surfaces of the gear housing.

17. A gear pump with reduced power requirement for the conveyance of viscous liquids, especially thermoplastic fiber-forming polymers or a viscose spinning liquid, said pump comprising meshed gear wheels mounted rotatably on parallel shafts in a pump housing circumscribing the gear wheels with liquid inlet means leading into the meshing point where the gear wheels disengage and liquid outlet means leading away from the meshing point where the gear wheels engage, a normal pressure-sealing axial gap space between the gears and the housing being enlarged by means of (a) at least one circular recess arranged in the side faces of the gear wheels or in the adjacent internal facing surfaces of the gear housing which extend perpendicular to the gear axes, and (b) at least one additional ring segment forming an axial recess which extends over only a part of said adjacent internal facing surfaces of the gear housing in such a manner as to begin and end at a distance corresponding to an angle of at least about 10° from the inlet opening and from the outlet opening, respectiviely, the inner radius of each additional ring segment being equal to and coinciding with the outer radius of said circular recess, each of said axial recesses being formed only circularly or as a circular segment and each such circular recess being arranged concentrically to the axis of its gear wheel.

* * * * *